US005738733A

United States Patent [19]

Inoue

[11] Patent Number: 5,738,733

[45] Date of Patent: Apr. 14, 1998

[54] FERROUS METAL GLASSY ALLOY

[75] Inventor: Akihisa Inoue, Sendai, Japan

[73] Assignee: Research Development Corporation of Japan, Kawaguchi, Japan

[21] Appl. No.: 657,786

[22] Filed: May 31, 1996

[30] Foreign Application Priority Data

Jun. 29, 1995 [JP] Japan ..... 7-136792

[51] Int. Cl.[6] ..... C22C 45/02

[52] U.S. Cl. ..... 148/304; 148/403

[58] Field of Search ..... 148/403, 304

[56] References Cited

PUBLICATIONS

"Fe-Based Ferromagnetic Glassy Alloys with Wide Supercooled Liquid Region", *Materials Transactions, JIM,* vol. 36, No. 9 (1995), pp. 1180–1183.

"Multicomponent Fe-Based Glassy Alloys with Wide Supercooled Liquid Region before Crystallization", *Material Transactions, JIM,* vol. 36, No. 10 (1995), pp. 1282–1285.

"Thermal and Magnetic Properties of Bulk fe-Based Glassy Alloys Prepared by Copper Mold Casting", *Materials Transactions, JIM,* vol. 36, No. 12 (1995), pp. 1427–1433.

"Effect of Additional Elements (M) on the Thermal Stability of Supercooled Liquid in $Fe_{72-x}Al_5Ga_2P_{11}C_6B_4M_x$ Glassy Alloys", *Materials Transactions, JIM,* vol. 37, No. 1 (1996), pp. 32–38.

*Primary Examiner*—Deborah Yee

*Attorney, Agent, or Firm*—Wenderoth, Lind & Ponack

[57] ABSTRACT

The present invention provides a ferrous metal glassy alloy having temperature interval ΔTx of supercooled liquid as expressed by the following formula:

$$\Delta Tx = Tx - Tg$$

(where, Tx is an onset temperature of crystallization, and Tg is a glass transition temperature) of at least 40 K, which realizes magnetic properties as a bulky alloy.

8 Claims, 6 Drawing Sheets

FERROUS METAL GLASSY ALLOY

BACKGROUND OF THE INVENTION

1. Field of the Invention

The present invention relates to a ferrous metal glassy alloy. More particularly, the present invention relates to a novel metal glassy alloy, available as a bulky alloy having a far larger thickness than a conventional amorphous alloy thin ribbon, excellent in magnetic properties.

2. Description of Related Art

Some of the conventional multi-element alloys are known to have a wide temperature region in which they are in a state of a supercooled liquid before crystallization and constitute metal glassy alloys. It is also known that these metal glassy alloys form bulky alloys having a far larger thickness than the conventionally known amorphous alloy thin ribbon.

The metal glassy alloys known as above include Ln-Al-TM, Mg-Ln-TM, Zr-Al-TM, Hf-Al-TM, and Ti-Zr-Be-TM (where, Ln is a lanthaned metal and TM indicates a transition metal).

However, none of these conventionally known metal glassy alloys are magnetic at room temperature, and this has lead to a significant restriction in industrial uses.

These alloys, while showing the supercooled liquid state, have no practicability because of a small temperature interval ΔTx of the supercooled liquid region, i.e., the difference (Tx−Tg) between the onset temperature of crystallization (Tx) and the glass transition temperature (Tg), practically resulting in a poor metal glass-forming ability. To judge from this fact, the presence of an alloy which has a wide temperature region of supercooled liquid and is capable of forming a metal glass through cooling would overcome the thickness restriction imposed on a conventional amorphous alloy thin ribbon and should metallurgically attract the general attention. In practice, however, the conventional metal glassy alloys which are not magnetic at room temperature have been under inevitable limitations.

SUMMARY OF THE INVENTION

The present invention was developed in view of the above-mentioned circumstances, and has an object to provide a novel metal glassy alloy which overcomes the limits in the conventional technology, permits manufacture as a bulky metal, and further allows application as a magnetic material.

The present invention provides a ferrous metal glassy alloy which comprises a ferrous alloy having a temperature interval ΔTx of a supercooled liquid as expressed by the following formula:

$$\Delta Tx = Tx - Tg$$

(where, Tx is an onset temperature of crystallization, and Tg is a glass transition temperature) of at least 40 K.

The present invention provides also embodiments wherein the above-mentioned alloy contains, together with iron, other metal and semi-metal elements, wherein the other metal elements are at least one selected from the group consisting of the metal elements of the III-B group and the IV-B group, and wherein the semi-metal elements are at least one selected from the group consisting of phosphorus, carbon, boron, silicon and germanium.

DETAILED DESCRIPTION OF THE INVENTION

Figure 1:
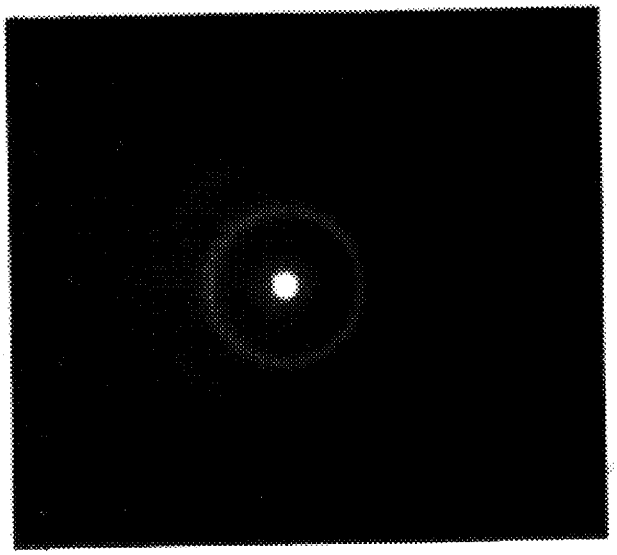
FIG. 1 shows a photograph of an electron diffraction pattern in place of a drawing of Example 1.

As described above, the present invention provides a novel magnetic metal glassy alloy at room temperature, which permits formation of a bulky alloy so far unknown.

Among ferrous alloys, Fe-P-C, Fe-P-B and Fe-Ni-Si-B ones are observed to exhibit glass transition. These alloys have however a very small temperature interval ΔTx of up to 25 K of the supercooled liquid, and cannot practically form metal glassy alloys. The metal glassy alloy of the present invention has in contrast a temperature interval ΔTx of the supercooled liquid of at least 40 K or even at least 60 K, which represents a remarkable temperature region which has not been anticipated at all to date as a ferrous alloy from conventional findings. Furthermore, the alloy of the present invention excellent also in magnetic properties is actually novel and is far superior in practical applicability to the conventional amorphous alloys applicable only as thin ribbons.

The alloy of the present invention is characterized by a chemical composition, as described above, mainly comprising iron and containing other metal and semi-metal elements. Of these, the other metal elements may be selected from the group consisting of metal elements of the II-A group, the III-A and III-B groups, the IV-A and IV-B groups, the V-A group, the VI-A group and the VII-A group, or more appropriately, metal elements of the III-B group and the IV-B group, including, for example, aluminum, gallium, indium and tin.

Such metals as titanium, hafnium, copper, manganese, niobium, molybdenum, chromium, nickel, cobalt, tantalum and tungsten may also be blended.

Applicable semi-metal elements include, for example, phosphorus, carbon, boron, silicon and germanium.

More specifically, the ferrous metal glassy alloy of the present invention comprises, in the following amounts, in atomic percentage:

| | |
|---|---|
| aluminum | from 1 to 10%, |
| gallium | from 0.5 to 4%, |
| phosphorus | from 9 to 15%, |
| carbon | from 5 to 7%, |
| boron | from 2 to 10%, and |
| iron | balance |

and may contain incidental impurities. Also it may contain from 0.5 to 2% silicon or 0.5 to 4% germanium.

Another embodiment covers an alloy composition containing, in addition to any of niobium, molybdenum, chromium, hafnium, tantalum and tungsten in an amount of up to 7%, up to 10% nickel and up to 30% cobalt.

In any of the embodiments of the present invention, the ferrous metal glassy alloy has a temperature interval ΔTx of a supercooled liquid of at least 40 K, or even at least 60 K.

In the present invention as described above, the metal glassy alloy can be manufactured through melting and casting, or quenching by means of a single roll or dual rolls, or further the in-rotating-liquid spinning process or the solution extraction process, or the high-pressure gas atomization, into bulk, ribbon, wire or powder shape. In this manufacture, there is available an alloy having a thickness and a diameter more than ten times as large as those for the conventional amorphous alloy.

These alloys show magnetism at room temperature and a better magnetism as a result of an annealing treatment. They are therefore useful for various applications as a material having excellent soft ferromagnetic properties.

As to manufacture, it should be added that an optimum cooling rate, depending upon the chemical composition of the alloy, means for manufacture, and size and shape of the product, may usually be set within a range of from 1 to $10^2$ K/s as a standard. In practice, the cooling rate may be determined by confirming whether or not such crystal phases as $Fe_3B$, $Fe_2B$, or $Fe_3P$ precipitates in the glassy phase.

Now, the metal glassy alloy of the present invention is described further in detail by means of working examples.

EXAMPLE 1

Iron, aluminum and gallium metals, an Fe-C alloy, an Fe-P alloy and boron as raw materials were induction-melted in an argon atmosphere, and cast into an alloy ingot of $Fe_{72}Al_5Ga_2P_{11}C_6B_4$ in atomic ratio. A ribbon having a cross-sectional area of $0.02\times1.5$ $mm^2$ was prepared in an argon atmosphere from the thus prepared ingot by the single roller melt-spinning process. It was confirmed through an X-ray diffraction and a TEM that the resultant ribbon had a metal glassy nature. Glass transition and crystallization were evaluated by means of a differential scanning calorimeter (DSC).

Figure 2:
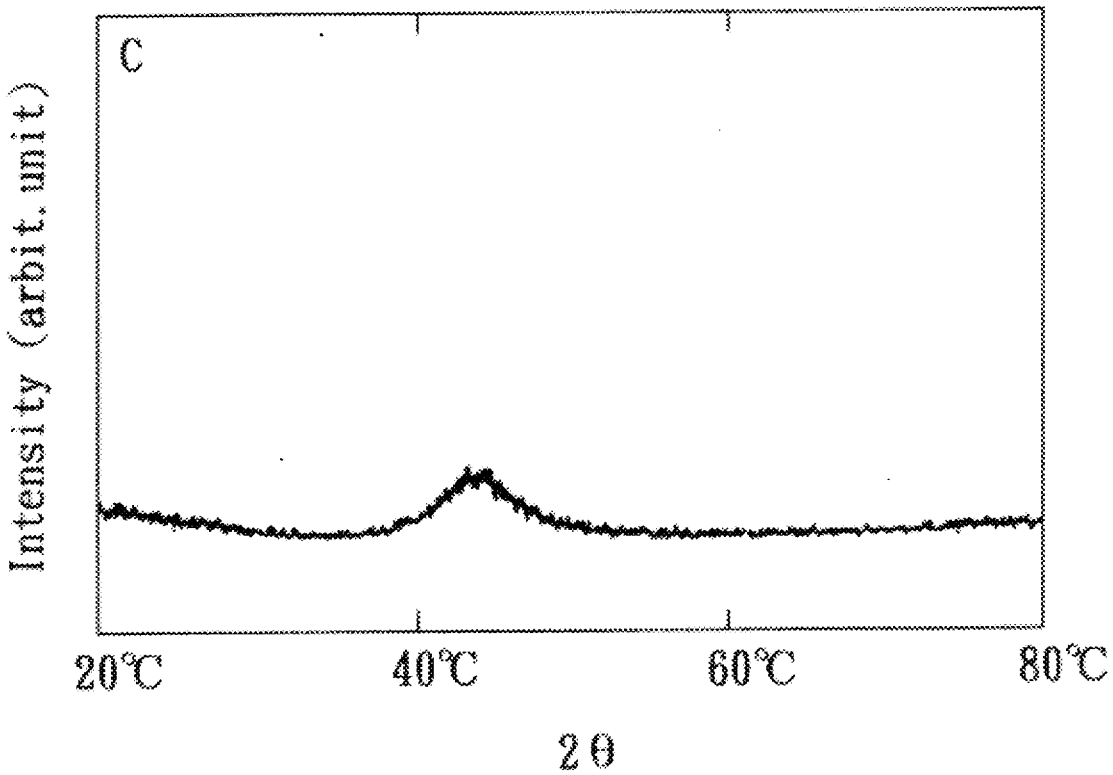
FIG. 2 shows an X-ray diffraction pattern of Example 1.
Figure 3:
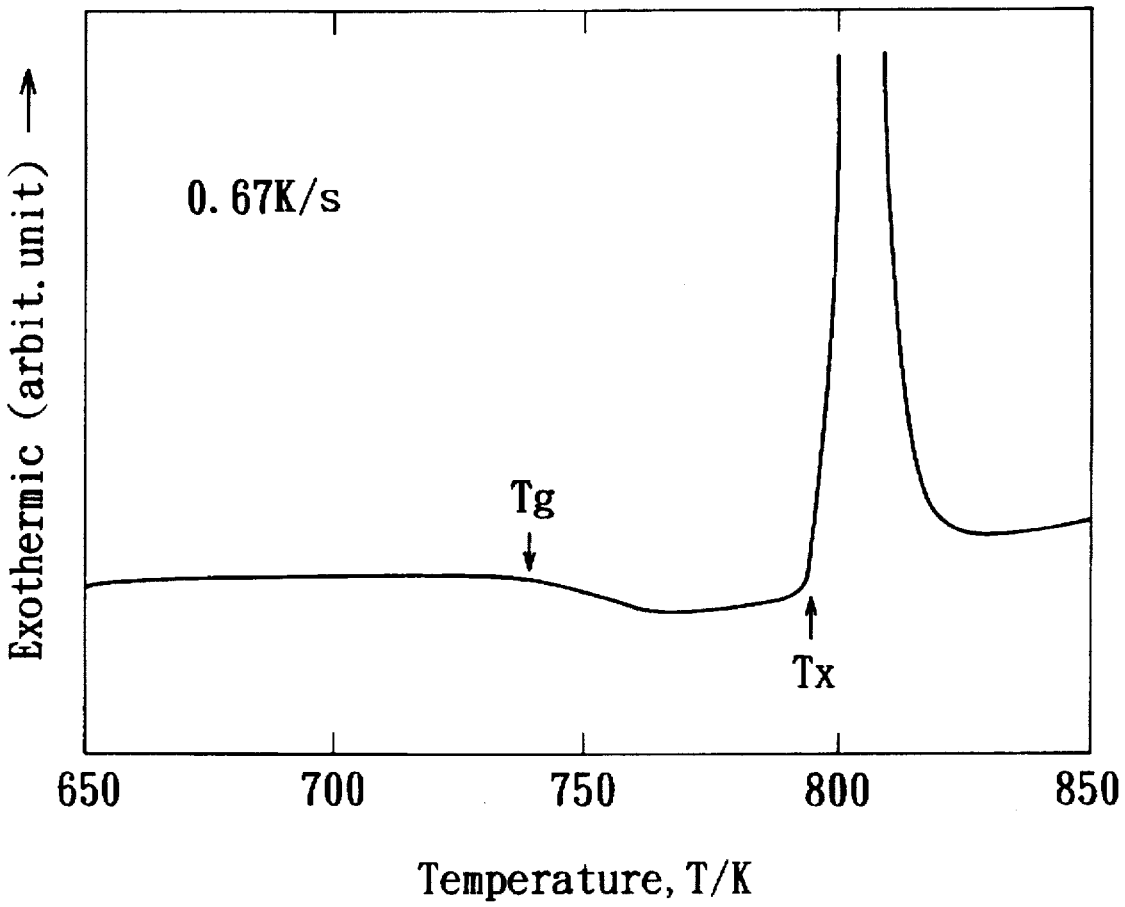
FIG. 3 shows a DSC curve of Example 1.

FIGS. 1 and 2 illustrate an electron diffraction pattern and an X-ray diffraction pattern, both demonstrating that the above alloy is of the glassy phase. FIG. 3 illustrates a DSC curve, suggesting that the alloy has a temperature interval of supercooled liquid, which represents the temperature difference (Tx–Tg) between the glass transition (Tg) temperature and the onset temperature of crystallization (Tx) of 61 K.

As a result of measurement at a scanning rate of 0.33 K/s by means of a differential thermal analyzer (DTA), the above alloy has a melting point (Tm) of 1,271 K, giving a ratio Tg/Tm of 0.58.

Figure 4:
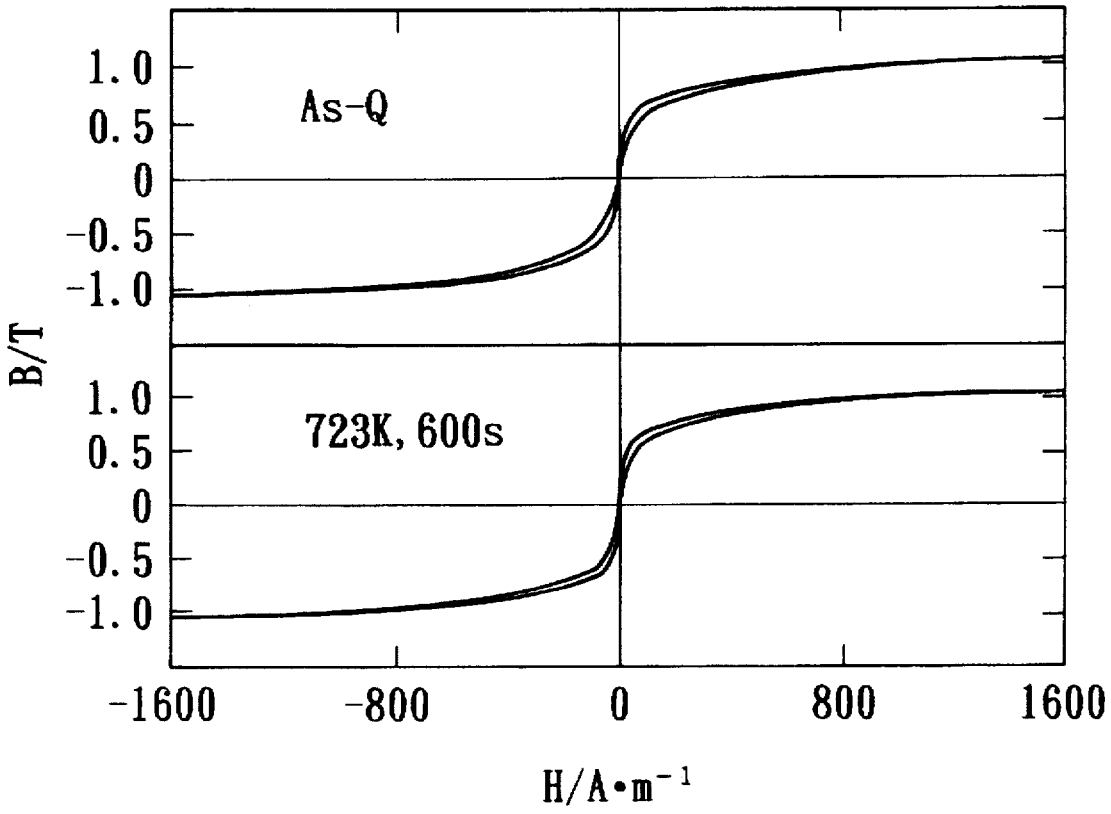
FIG. 4 shows a B–H curve of Example 1.

Evaluation of magnetic properties of the alloy revealed that the as-quenched alloy and the alloy after an annealing treatment at 723 K for 600 s exhibited hysteresis B–H curves with 1.59 kA/m at room temperature as shown in FIG. 4, respectively. Bs, He, $\lambda_s$ and μe were as shown in Table 1.

TABLE 1

| | As-quenched | Annealed |
|---|---|---|
| Bs (T) | 1.07 | 1.07 |
| Hc (A/m) | 12.7 | 5.1 |
| λs | $2.0\times10^{-6}$ | — |
| μc at 1 kHz | 3600 | 9000 |

This result suggests that the above-mentioned metal glassy alloy has excellent soft ferromagnetic properties.

EXAMPLE 2

An alloy having an atomic composition of $Fe_{73}Al_5Ga_2P_{11}C_5B_4$ was melted in the same manner as in Example 1, and a bar-shaped alloy sample having a circular cross-section was prepared through injection molding in a copper die. The sample had a length of about 50 mm and a diameter of from 0.5 to 2.0 mm. Forming was carried out under a pressure of 0.05 MPa.

Observation of the outer surface permitted confirmation that the alloy has a smooth surface and a satisfactory metallic gloss, with a good formability. Then, after etching the alloy with a solution comprising 0.5% hydrofluoric acid and 99.5% distilled water at 293 K for 10 s, the cross-section was observed by means of an optical microscope. This microscope observation revealed that a crystal phase was non-existent and the alloy comprised a glassy phase.

Figure 5:
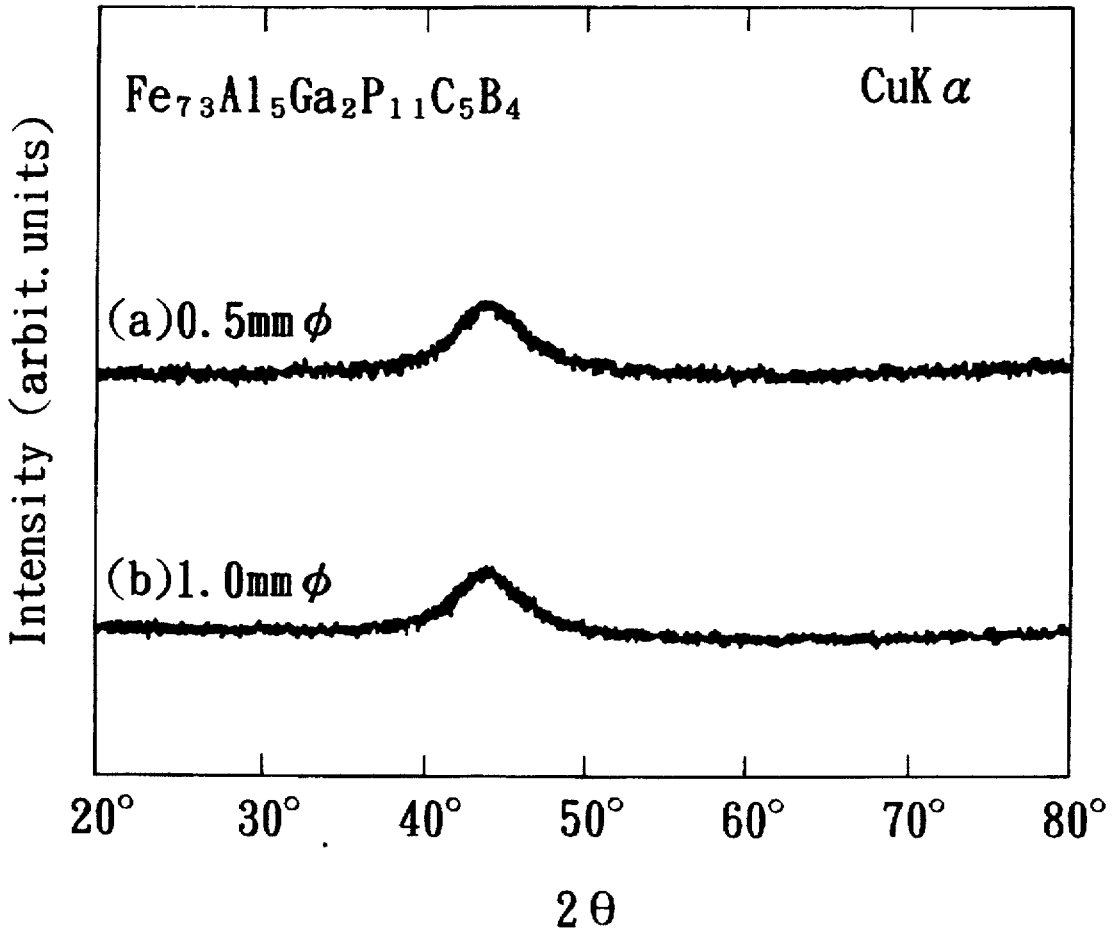
FIG. 5 shows an X-ray diffraction of Example 2.

The results of an X-ray diffraction analysis for samples having a diameter of 0.5 mm and 1.0 mm are shown in FIG. 5: broad peaks are observed only at and around a 2θ of 43.6° and a peak corresponding to a crystal phase is not found at all. This suggests the fact that, even with a diameter of 1.0 mm, the resultant alloy comprises a glassy phase.

Figure 6:
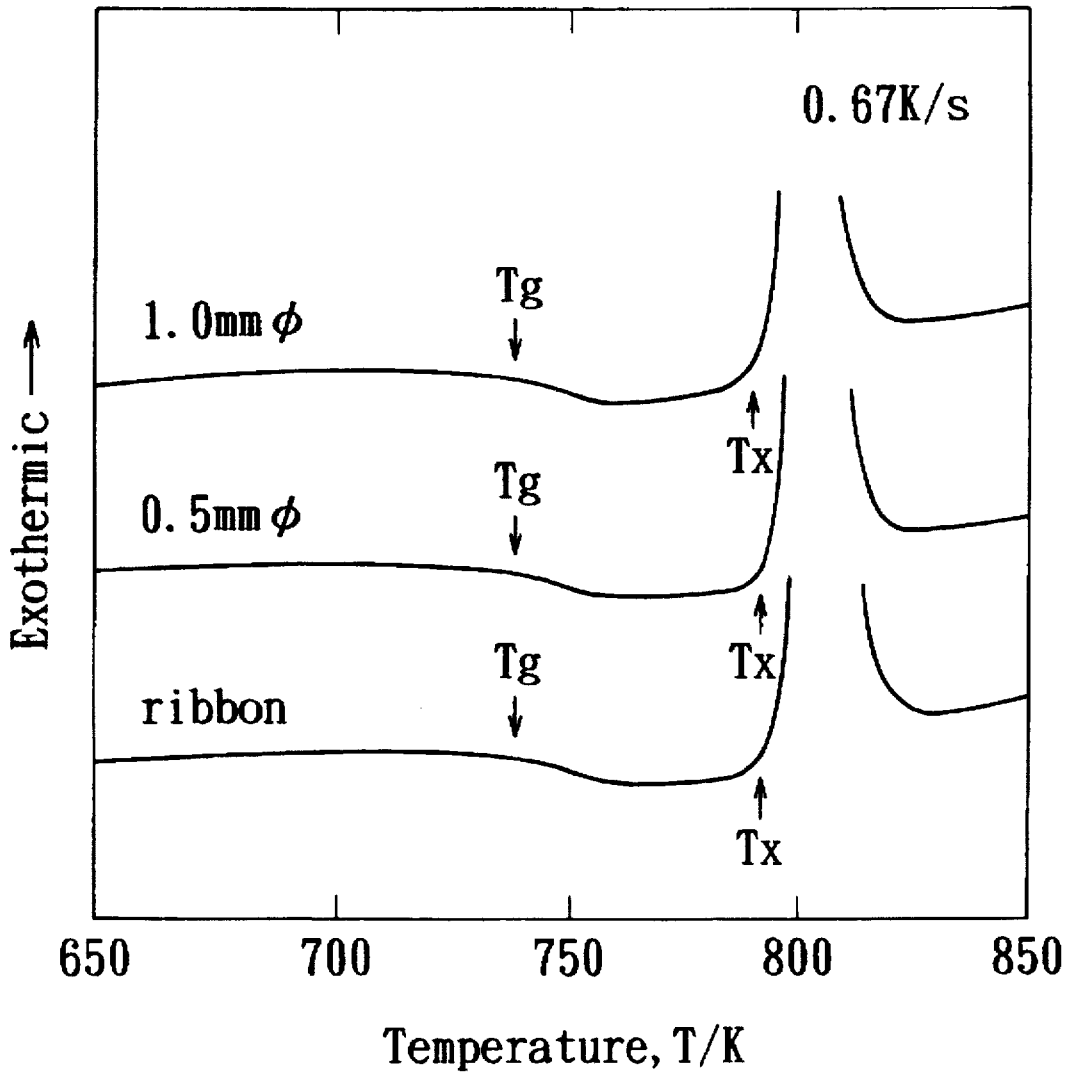
FIG. 6 shows a DSC curve of Example 2.

FIG. 6 illustrates DSC curves for alloy samples having diameters of 0.5 mm and 1.0 mm and a ribbon sample as in Example 1. In all cases, the curves demonstrate a glass transition temperature (Tg) of 732 K, an onset temperature of crystallization (Tx) of 785 K and a temperature interval of supercooled liquid (ΔTx) of 53 K.

Figure 7:
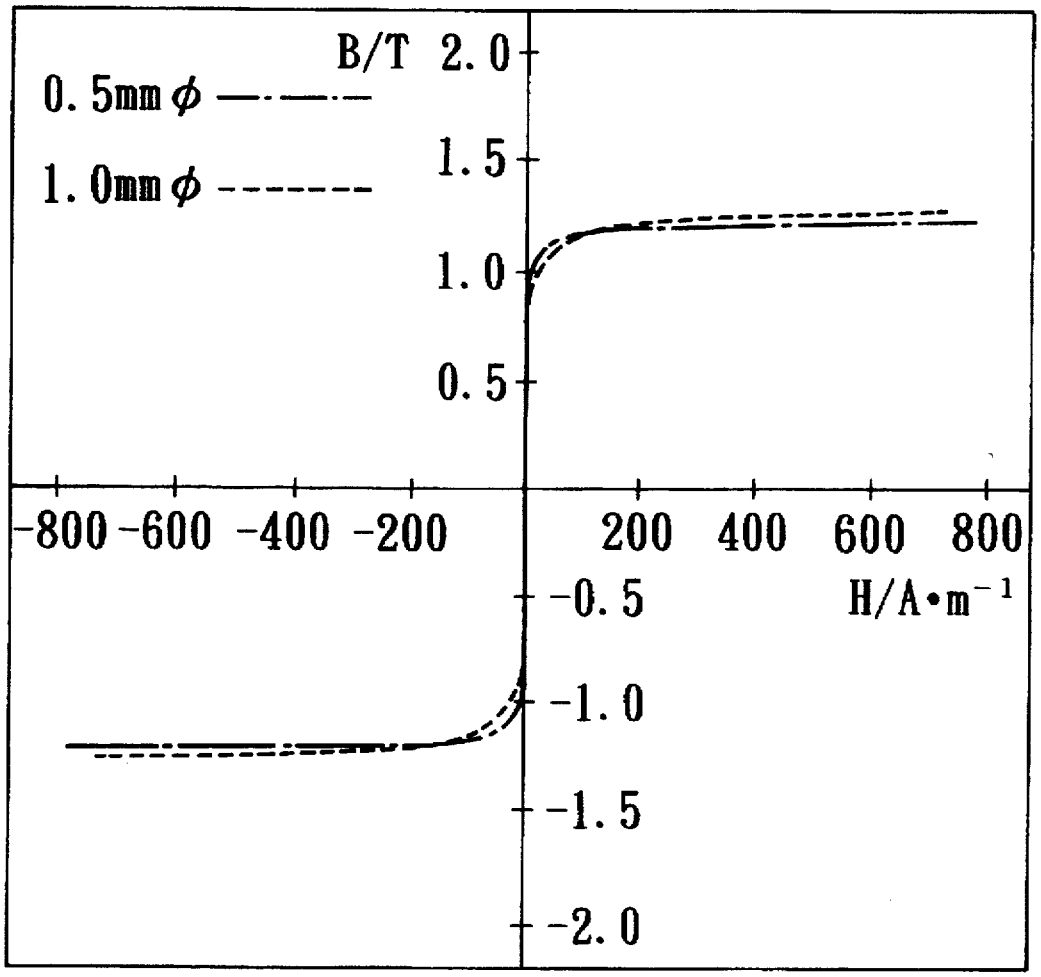
FIG. 7 shows a B–H hysteresis curve of Example 2.

FIG. 7 shows a hysteresis B–H curve. Magnetic properties were confirmed to be equivalent with those in Example 1.

It is needless to mention that the present invention is not limited at all by the above-mentioned examples, and that various embodiments are possible as to its chemical composition, manufacturing process, annealing treatment, shape and the like.

According to the present invention, as described above in detail, there is provided a ferrous metal glassy alloy which overcomes the restrictions such as the thickness of conventional amorphous alloy thin ribbon, can be supplied as a bulky alloy, and is expected to be applicable as a material having magnetic properties.

What is claimed is:

1. A ferrous metal glassy alloy, comprising at least one metal selected from the group consisting of aluminum, gallium, indium and tin, at least one semi-metal element selected from the group consisting of phosphorus, carbon, boron, silicon, and germanium, with the balance being iron, and wherein the ferrous metal glassy alloy has a temperature interval ΔTx of a supercooled liquid of at least 40 K, as determined by the following formula:

$$\Delta Tx = Tx - Tg$$

where Tx is an onset temperature of crystallization and Tg is a glass transition temperature.

2. The ferrous metal glassy alloy according to claim 1, comprising, in atomic percentage:

from 1 to 10% aluminum, from 0.5 to 4% gallium, from 9 to 15% phosphorus, from 5 to 7% carbon, from 2 to 10% boron, and the balance being iron, wherein the alloy may contain incidental impurities.

3. The ferrous metal glassy alloy according to claim 2, further comprising from 0.5 to 2% silicon.

4. The ferrous metal glassy alloy according to claim 2, further comprising 0.5 to 4% germanium.

5. The ferrous metal glassy alloy according to claim 1, further comprising up to 7%, in atomic percentage, of at least one element selected from the group consisting of niobium, molybdenum, hafnium, tantalum, tungsten and chromium.

6. The ferrous metal glassy alloy according to claim 1, further comprising up to 10%, in atomic percentage, of nickel.

7. The ferrous metal glassy alloy according to claim 1, further comprising up to 30%, in atomic percentage, of cobalt.

8. The ferrous metal glassy alloy according to claim 1, which is annealed.

* * * * *